United States Patent [19]

Kragten

[11] Patent Number: 4,785,846

[45] Date of Patent: Nov. 22, 1988

[54] GAS CONTROL APPARATUS WITH A PRESSURE REGULATOR

[75] Inventor: Cornelis A. Kragten, Emmen, Netherlands

[73] Assignee: Honeywell B.V., Netherlands

[21] Appl. No.: 116,998

[22] Filed: Nov. 5, 1987

[30] Foreign Application Priority Data

Dec. 24, 1986 [EP] European Pat. Off. ..... 86118069.3

[51] Int. Cl.[4] ..... G05D 16/20

[52] U.S. Cl. ..... 137/489; 137/495

[58] Field of Search ..... 137/489, 495

[56] References Cited

U.S. PATENT DOCUMENTS 3,351,085 11/1967 Allingham ..... 137/489 X
4,087,231 5/1978 Matthews ..... 137/489 X
4,406,400 9/1983 Berkhof ..... 137/489 X

FOREIGN PATENT DOCUMENTS 39000 4/1981 European Pat. Off. .
62856 2/1982 European Pat. Off. .

*Primary Examiner*—Robert G. Nilson

*Attorney, Agent, or Firm*—Mitchell J. Halista; Albin Medved

[57] ABSTRACT

A gas control apparatus with a pressure regulator selectively controls the setpoint of the regulator by an electrical current between a minimum and a maximum value of the gas outlet pressure. A diaphragm of the regulator is exposed to the pressure to be controlled and carries a closure member of a bleed valve. A control spring for determining the setpoint of the gas pressure acts between the diaphragm and an adjustable abutment. A solenoid actuator acts between a valve rod of a switch-on valve located between an inlet of the apparatus and the regulator and the abutment. A reset spring for the armature of the actuator acts between a stationary abutment and the armature to engage the armature after the armature has opened the switch-on valve. Thus, the solenoid actuator responds to an electrical current to control the operation of the switch-on valve to provide an inlet pressure for the regulator. The minimum and maximum setpoint levels can be separately adjusted by adjusting stops for the armature while the slope of the pressure/current characteristic is adjusted by adjusting a tension of the reset spring of the armature.

9 Claims, 3 Drawing Sheets

FIG. 1c
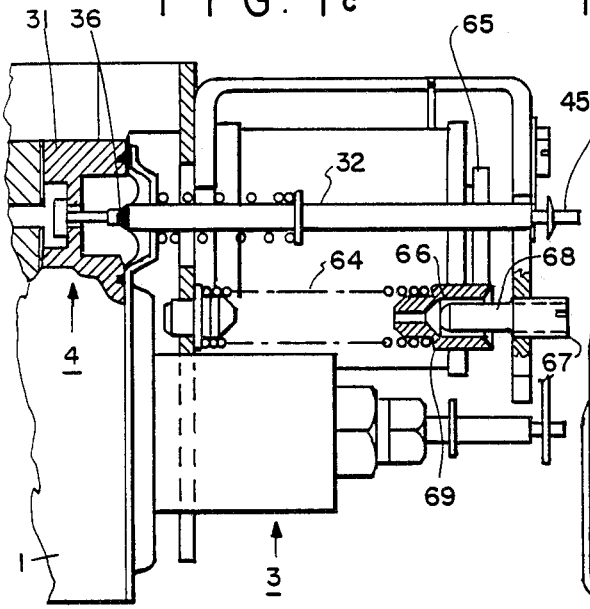
FIG. 1a
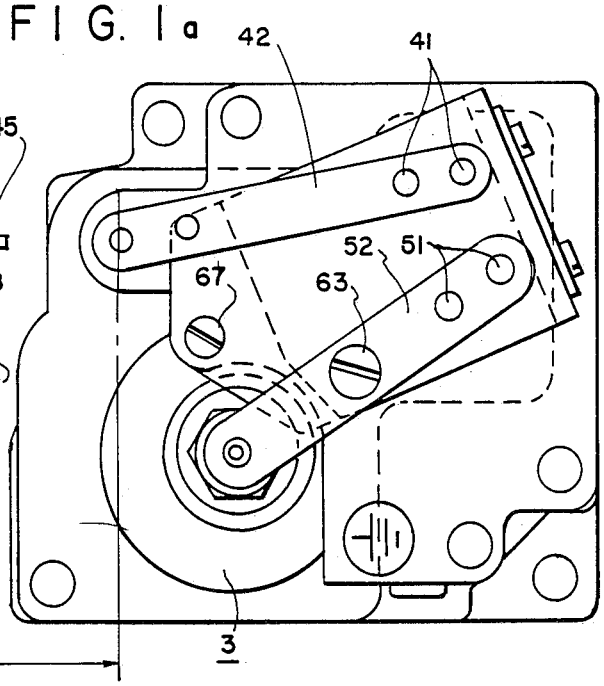
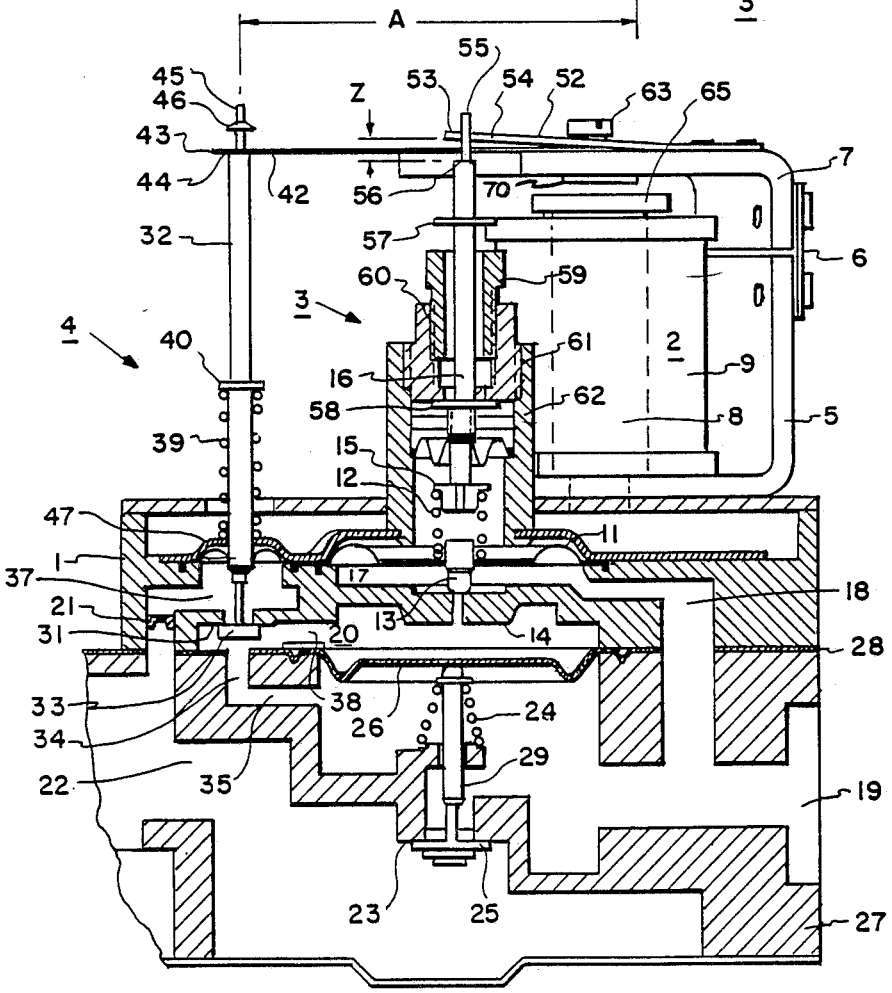
FIG. 1b
FIG. 1

GAS CONTROL APPARATUS WITH A PRESSURE REGULATOR

BACKGROUND OF THE INVENTION

1. Field of the Invention

The present invention relates to gas pressure control apparatus. More specifically, the present invention is directed to a gas control apparatus having an adjustable outlet gas pressure.

2. Description of the Prior Art

Gas control apparatus for controlling a gas pressure is well-known in the art for providing an outlet gas pressure regulated with respect to an adjustable setpoint. European Pat. No. 00 62 856 shows a gas control apparatus with a gas pressure regulator where the setpoint of the regulator can be adjusted by means of a solenoid operator, which is mounted on the pressure regulator. This pressure regulator is supplied via a throttle and an actuator solenoid valve with the gas supply pressure as available at the inlet of the gas control apparatus, and this pressure is used as auxiliary energy for the servopressure regulator. The regulator controls the pressure at the outlet of the gas control apparatus and for this purpose acts upon a diaphragm which with its opposite side engages a control spring. The stationary abutment of this control spring is adjusted by means of said solenoid operator therewith adjusting the setpoint of the pressure regulator. It is also known in the art to provide an electromagnetic actuator having a variable spring rate for an armature bias spring as shown in U.S. Pat. No. 4,290,040. This bias spring has a spring constant which depends on the actual position of the armature of the solenoid and which increases when the air gap between the armature and the magnetic core decreases. In order to achieve this the blade spring forming the control spring abuts against a support which changes the effective length of the spring dependent on the position of said armature. The present invention provides a gas control apparatus which works without such a special control spring with non-linear characteristic and furthermore is easier and less expensive to manufacture and to adjust.

SUMMARY OF THE INVENTION

An object of the present invention is to provide an improved gas control apparatus.

In accomplishing this and other objects, there has been provided, in accordance with the present invention, a gas control apparatus with a pressure regulator selectively controls the setpoint of the regulator by an electrical current between a minimum and a maximum value of the gas outlet pressure. A diaphragm of the regulator is exposed to the pressure to be controlled and carries a closure member of a bleed valve. A control spring for determining the setpoint of the gas pressure acts between the diaphragm and an adjustable abutment. A solenoid actuator acts between a valve rod of a switch-on valve located between an inlet of the apparatus and the regulator and the abutment. A reset spring for the armature of the actuator acts between a stationary abutment and the armature to engage the armature after the armature has opened the switch-on valve. Thus, the solenoid actuator responds to an electrical current to control the operation of the switch-on valve to provide an inlet pressure for the regulator. The minimum and maximum setpoint levels can be separately adjusted by adjusting stops for the armature while the slope of the pressure/current characteristic is adjusted by adjusting a tension of the reset spring of the armature.

BRIEF DESCRIPTION OF THE DRAWINGS

A better understanding of the present invention may be had when the following description is read in connection with the accompanying drawings, in which:

FIGS. 1*a*, 1*b* and 1*c* are a top view of a first cross-sectional illustration and a second cross-sectional illustration, respectively, of a gas control apparatus embodying an example of the present invention.

DESCRIPTION OF THE PREFERRED EMBODIMENT

Figures 2, 2A, 2B, 2C:
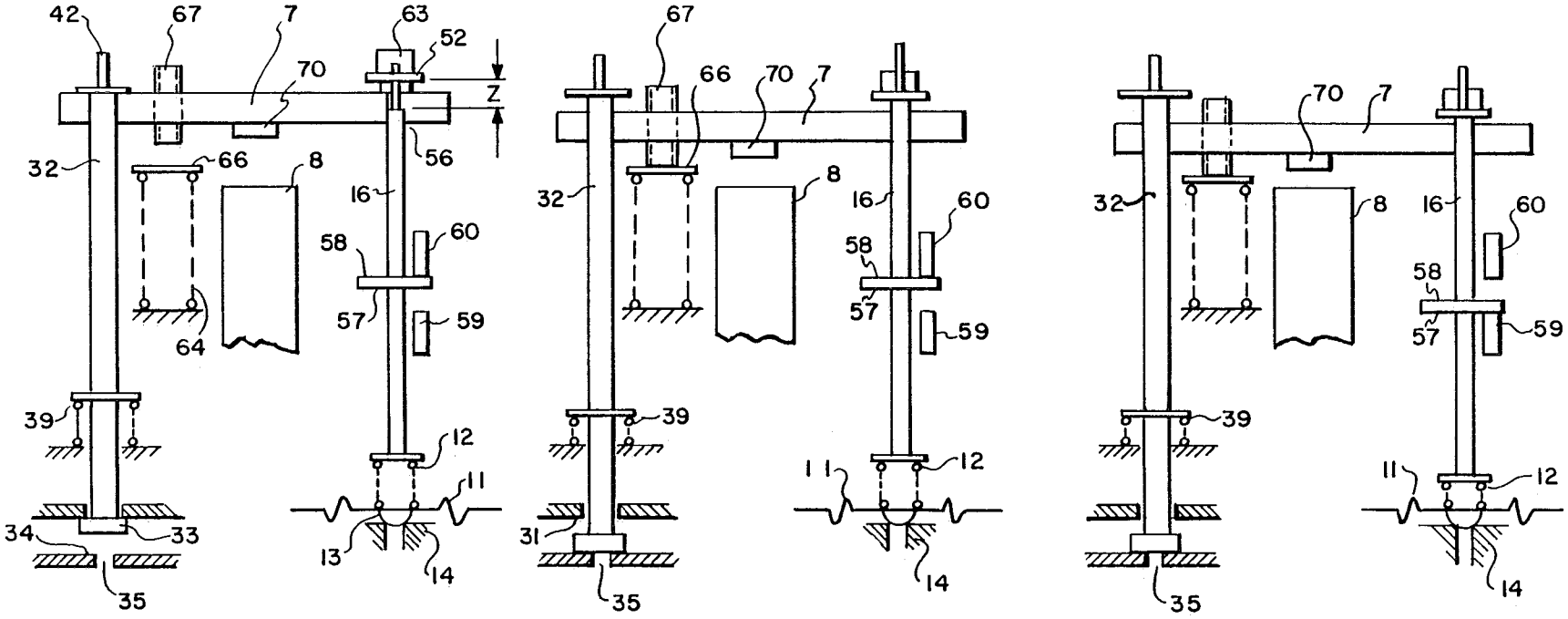
FIGS. 2*a*, 2*b* and 2*c* are schematic illustrations of the operating connection between the armature of the solenoid and the valve rod of the switch-on valve and the operating pin of the pressure in different operating conditions.

As shown in FIGS. 1*a*, 1*b* and 1*c*, an upper part 1 of a housing supports a solenoid 2, a pressure regulator 3 and a switch-on valve 4. In FIG. 1*c* the actual position of the pressure regulator 3 and the switch-on valve 4 is shown whereas in FIG. 1*b* the switch-on valve 4 is offset with respect to the servopressure regulator by an amount "A" to the left side in order to avoid obscuring internal parts. The solenoid 2 consists of a yoke 5, an armature 7 connected to the yoke by means of a spring blade 6, a magnetic core 8, and a coil 9 surrounding the core 8. The pressure regulator 3 carried by the upper portion 1 of the housing consists of a diaphragm 11, a control spring 12, a closure member 13 carried by the diaphragm 11, and a valve seat 14 working together with the closure member 13. The closure member 13 and the valve seat 14 together form a servo valve. The control spring 12 has its end which is located opposite to the diaphragm 11 held by a supporting piece 15 provided at the free end of operating pin 16. A diaphragm chamber 17 located between the diaphragm 11 and the valve seat 14 is connected to an outlet side 19 of the gas control valve by means of a fluid channel 18. A chamber 20 below the valve seat 14 has one side connected via switch-on valve 4 and a throttle 21 to an inlet 22 of the gas control apparatus and on the other side forms the operating chamber of a diaphragm operated gas control valve. This valve consists of a valve seat 23 provided between an inlet 22 and a gas outlet 19 and an associated closure member 25 spring biased in a closing direction by means of a spring 24. The pressure in the actuator chamber 20 acts in an opening direction via diaphragm 26 on the closure member 25. The gas control valve 23, 24, 25, 26 is located in a lower portion 27 of the housing which is attached to the upper portion 1 with a sealing plate 28 provided between these two portions of the housing.

If a high control pressure exists in the chamber 20, it opens, via diaphragm 26, the control valve 23 to 25 further than in the case of low control pressure. To reduce the control pressure in chamber 20, the closure member 13 can lift off from the valve seat 14 in order to bleed off the control pressure within the chamber 20 to the outlet 19 of the gas control apparatus via the diaphragm chamber 17 and channel 18. The design and operation of such kind of servopressure regulators is well-known, e.g., from European Pat. Nos. 00 62 856 and 00 39 000.

The upper portion 1 of the housing further supports the switch-on valve 4 as shown in FIGS. 1*b* and 1*c* and consisting of a valve seat 31 and a closure member 33 carried by a valve rod 32 and further comprising a second valve seat 34 located opposite the seat 31 and including a passage 35 to the outlet 19 of the gas control apparatus. A sealing diaphragm 36 seals the chamber 37 on the upper side of the valve seat 33 against the valve rod 32 extending through diaphragm 36. The chamber 37 is connected to the inlet 22 of the gas control apparatus via the throttle 21. The space between the two valve seats 31 and 34 of the switch-on valve 4 is connected via a passage 38 to the actuator chamber (see FIG. 1*b*). A closure spring 34 abuts its one end against the upper portion of the housing and with its opposite end engages a collar 40 of the valve rod 32. This spring 34 biases the closure member 33 of the switch-on valve 4 in a closing direction to valve seat 31.

When the switch-on valve 31, 33 is opened, an inlet pressure enters operator chamber 20 via the throttle 21. In this manner, the operator chamber 20 of the control valve 23 to 26 is provided with the required auxiliary energy, i.e., the inlet gas pressure. If the gas pressure at the outlet 19 exceeds a setpoint as provided by the operating pin 16 via a control spring 12, this pressure acts upon the lower side of the control diaphragm 11 and moves this diaphragm 11 such that the closure member 13 is lifted from the valve seat 14. The control pressure in the operating chamber 20 is partially vented to the outlet 19 via the valve 13, 14. Because of this reduction of the control pressure in the chamber 20, the closure spring 24 of the control valve 23 to 25 can move its closure member 25 in the direction of a closing position. Therewith the closure member 25 reduces the gas flow between the inlet 22 and the outlet 19 and therewith also reduces the outlet pressure of the gas control apparatus. If on the other hand, the gas pressure at the outlet 19 decreases and therewith also the force acting from below on the control diaphragm 11 is reduced, then a higher control pressure builds up in the operating chamber 20 because the bleed-off valve 13, 14 is maintained closed by the force of the control spring 12. This increased control pressure in the chamber 20 moves the diaphragm 26 and with it the closure member 25 of control valve 23 to 25 downwards whereby the control valve 23 to 25 is opened further, and the outlet pressure increases again.

By means of two rivets 41, a blade spring 42 is fixed to armature 7 of the solenoid with a free end 43 of said blade spring 42 acting upon the valve rod 32 of the switch-on valve 4. For this purpose, valve rod 32 is provided with a collar 44 where the free end 43 of blade spring 42 engages with the end 43 having a bore through which the end 33 projects. An end portion 45 of the valve rod 32 has a reduced diameter and carries a ring 46 in a surface groove. The valve rod 32 is biased by the reset spring 39 which with its one side abuts stationarily against an intermediate wall 47 and with its other side against collar 40 of valve rod 32. A spring 39 acts in the closing direction of switch-on valve 31 to 33.

Furthermore, by means of two rivets 51 relatively stiff cantilever 52 is fixed to armature 7. This cantilever is a flat blade with a bore 53 being provided in its free end 53. An end portion 55 of the operating pin 16 has a reduced diameter and projects through the bore 53. The pin 16 has a collar 56 against which the free end 53 of the cantilever 52 abuts during an operation for moving pin 16. The movement of pin 16 in an axial direction is limited by two abutments provided by rings 57 and 58. The ring 57 cooperates with a threaded sleeve 59 which can be adjusted within a threaded busing 60. The bushing 60 can be adjusted on a thread 61 of stationary tube 62.

The cantilever 52 as shown in 1*b* is bent with its free end away from the plane of the armature 7 and is under the tension of a screw 63 having a head which urges cantilever 52 in the direction toward armature 7. The screw 63 is screwed into a threaded bore of the armature 7. The armature 7, as shown in FIG. 1*c*, is pushed away from a pole piece 65 of the magnetic core 8 by means of a reset spring 64. For this purpose, the spring 64 has one end abuting against the upper portion 1 of the housing and its other end engaging the free end of a transmission member 66 into which an adjustable adjustment screw 67 projects with a pin-like projection 68. The screw 67 can be adjusted with respect to the armature 7. As soon as the pin projection 68 engages the bottom of the cylindrical bore of transmission member 66, the reset spring 64 pushes the armature 7 away from the pole piece 65 by means of adjusting screw 67. The armature 7 is further subject to the force of the valve rod 32 which is spring biased by the closure spring 39. The valve rod 32 urges the armature 7 away from the pole piece 65 via the collar 44 and the blade spring 42.

In describing the operation of the gas control apparatus, reference is made to FIGS. 2*a*, 2*b* and 2*c*, in which:

FIG. 2*a* shows the position of armature 7, valve rod 32 and operating pin 16 in the position when the gas control apparatus is switched-off and the switch-on valve 4 is closed, FIG. 2*b* shows the position of the above-mentioned parts when the switch-on valve 4 is opened but the pressure regulator is not yet acting, which means that a minimum outlet pressure is present at the outlet of the gas control apparatus, FIG. 2*c* shows the position of these parts when the pressure regulator is adjusted to an outlet pressure which lies between the minimum and the maximum outlet pressure, i.e., the pressure regulator is operating within its modulating range.

If no current flows through the coil 9 the closure spring 39 keeps the switch-on valve 31 to 33 closed via the collar 40 and the valve rod 32. The closure spring 24 keeps the closure member 25 of the gas control valve closed as well. Therewith, the outlet pressure P at the outlet 19 of the gas control apparatus is zero (see FIG. 3). Under the influence of the control spring 12, the operating pin 16 engages bushing 60 with its ring 58. Control spring 12 at this time has the least possible spring bias.

As soon as the current through coil 9 is switched-on and reaches a predetermined minimum amount, the armature 7 tilts around the spring joint 6 and, by means of spring blade 42, presses the valve rod 32 downwards against the force of the reset spring 39. Therewith the closure member 33 is lifted from the valve seat 31, and gas can flow from the inlet 22 of the gas control apparatus via the throttle 21 through the switch-on valve 31 to 33 into the operator chamber 20 of the diaphragm operator for the gas control valve 23 to 26. Simultaneously, the closure member 33 closes the opposite valve seat 33 and therewith closes the connection between the operator chamber 20 and the passage 35 to the outlet 19. As soon as a sufficient pressure has built up in the chamber 20, the diaphragm 26 moves the pin 29 of the closure member 25 downwards and thereby moves the closure member 25 away from the valve seat 23 whereby gas from the inlet 22 can flow to the outlet 19. The pressure at the outlet 19 simultaneously is supplied via the passage 18 to the chamber 17 below the control diaphragm 11 of the pressure regulator.

Figure 3:
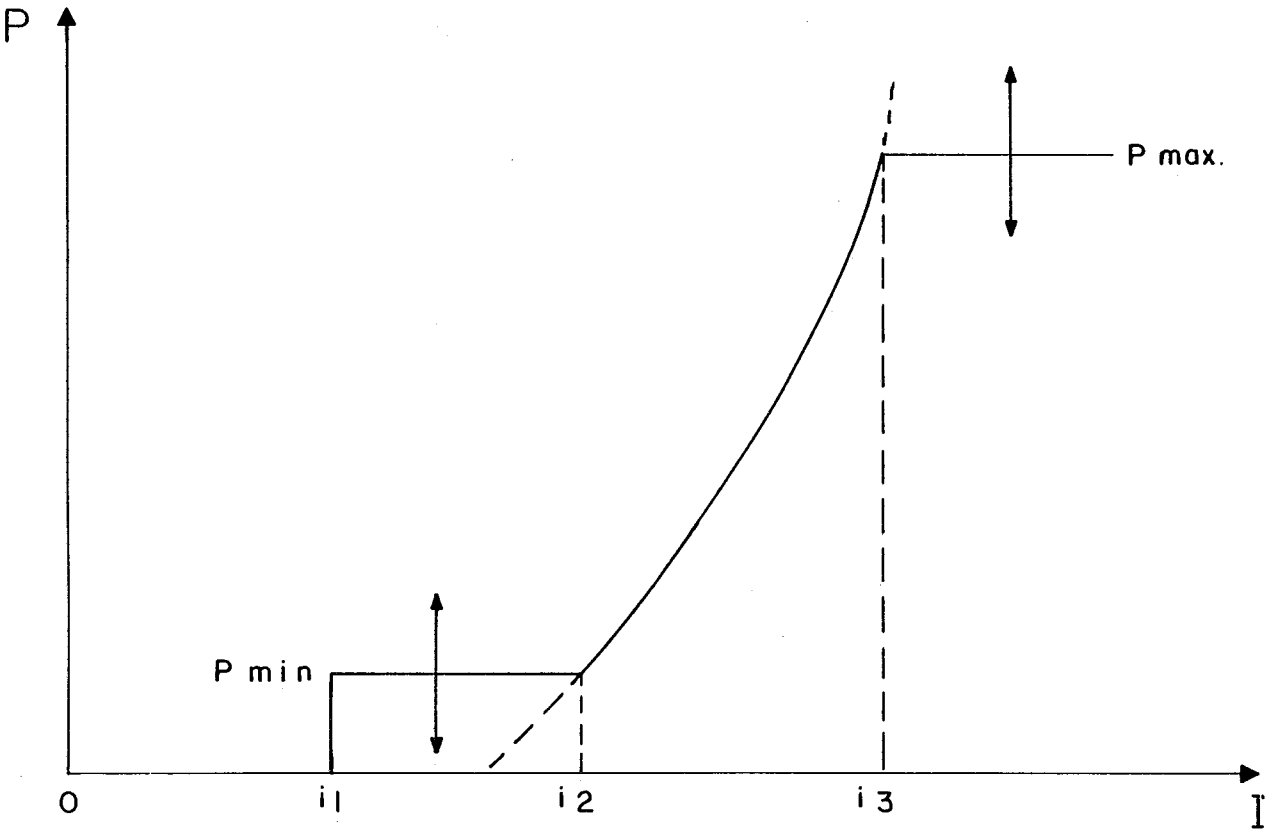
FIG. 3 is an illustration of a curve showing the relationship of the output pressure P of the pressure regulator versus the current I flowing through the coil of the solenoid.

If the outlet pressure exceeds above a value at which the force of the control spring 12 acting upon the upper side of the diaphragm 11 exceeds the force which by the gas pressure within the chamber 17 acts on the lower side onto the diaphragm 11, the closure member 13 is lifted from the valve seat 14, and the pressure within the operator chamber 20 is vented to the outlet 19 via the control valve 13, 14 at the passage 18. This reduction of the pressure results in a reduction of the force acting upon the diaphragm 26 such that the closure spring 24 of the control valve 23 to 26 moves its closure member 25 into a position of reduced gas flow whereby the pressure at the outlet 19 is reduced again. A force balance is generated which determines the minimum gas pressure P at the outlet 19. FIG. 3 shows in the range between $I=0$ to $I=i_1$ the range in which the armature 7 is moved but the switch-on valve 4 is not yet opened. At a current $i_1$, the switch-on valve 4 starts to open and, in the manner as described above, generates the minimum outlet pressure $P_{min}$. The amount of this pressure can be adjusted by means of sleeve 59 which as mentioned above cooperates with the ring 58 on the operating pin 16. During the actuation of the switch-on valve 4, i.e., during the transition from the position of the parts according to FIG. *2a* to the position of FIG. *2b*, the adjusting screw 67 does not yet engage the transmission member 66 of the reset spring 64, and cantilever 52 does not yet act upon the operating pin 16 via the collar 56.

When the current I is increased further and reaches a value $i_2$, the position of the parts as shown in FIG. *2b* is reached. Now the adjusting screw 67 with its cylindrical projection 68 engages the bottom 69 of the transmission member 66. Furthermore, the cantilever 52 has moved through a dead zone "Z" to collar 56 of operating pin 16, and when the current increases further it will move operating pin 16 by means of said collar 56. Before this happens, the blade spring 42 has moved the valve rod 32 so far that the reset spring 39 is heavily biased, and the closure member 33 rests on the opposite seat 34. Therewith the closure member 33 closes the passage 35 to the outlet 19 of the gas control apparatus. If the current I increases above the value $i_2$, changes through the modulating range to value $i_3$, the cantilever 52 moves the operating pin 16, as shown in FIG. *2c*, downwards and compresses control spring 12. Therewith the force acting upon the upper side of diaphragm 11 is increased. This force determines the outlet pressure of the gas control apparatus. The further that the operating pin 16 is moved downwards, the higher this force will become, and the higher will become the outlet pressure fed into the chamber 17 via the passage 18 before this outlet pressure via the diaphragm 11 is able to move the closure member 13 of bleed valve 13, 14 away from its seat 14. This outlet pressure increases the force of the control spring 12 and opens valve 13, 14 whereby the control pressure in the operating chamber 2 is vented to the outlet 19 via the valve 13, 14 and the passage 18. Therewith the closure spring 24 of the control valve moves its closure member 25 upwards and therewith reduces the gas flow through the valve and therewith also reduces the outlet pressure P. With increasing current through the coil 9, the outlet pressure P increases within the modulating range between current values $i_2$ and $i_3$ as shown in FIG. *2c*.

Finally when a current value $i_3$ is reached, the operating pin 16 is moved so far downwards that the ring 57 engages threaded sleeve 59. Therewith the maximum outlet pressure Pmax is reached. This maximum pressure can be adjusted by means of turning sleeve 59 within bushing 60. On the other hand, the minimum outlet pressure Pmin can be adjusted by screwing bushing 60 within thread 61 of the stationary tube piece 62.

As shown in FIG. *2b*, as soon as the adjusting screw 67 engages transmission member 66 by a further movement of the armature 7, the reset spring 64 is brought under tension as well. It therewith supports control spring 12. By adjusting the screw 67 the amount or the influence of the reset force generated by the spring 64 on the armature 7 can be adjusted. In this manner the steepness, i.e., slope, of the pressure/current characteristic within the modulating range may be changed. The length of dead zone "Z" is adjusted by means of the screw 63 which with its head engaging the cantilever 52 determines how much the centilever 52 is positioned away from the plane of armature 7. A non-magnetic distance piece 70 on the armature 7 insures that the armature 7 under no circumstances can engage the pole piece 65 and can stick to the pole piece 65.

For switching off the gas control apparatus the current I is interrupted so that the armature 7 under the influence of the reset spring 64 and the control spring 12 moves back into the resting position as shown in FIG. *2a*. The armature 7 with its blade spring 42 releases the valve rod 32 so that the reset spring 39 can move the closure member 33 into the closed position as shown in FIG. *2a*. Therewith the pressure regulator is separated from the inlet pressure by means of the closure member 33, and the control pressure within the chamber 20 is vented via the passage 35 to the outlet. As a result of this reduction of the control pressure the closure spring 34 of the gas control apparatus moves closure member 35 into the closed position.

An essential advantage of the present invention is seen in the fact the by means of a single solenoid operator and by using normal springs and other components the operation of the switch-on solenoid valve 4 as well as the control of the setpoint of the pressure regulator can be achieved by an electrical current. Therewith the setpoint can be continuously changed between a minimum value and a maximum value of the outlet pressure. Further, the minimum pressure as well as the maximum pressure can be adjusted separately, and the steepness of the control characteristic within the modulating range is also selectively changeable.

Accordingly, it may be seen that there has been provided, in accordance with the present invention, an improved gas pressure regulator.

The embodiments of the present invention in which an exclusive property or privilege is claimed are defined as follows:

1. A gas control apparatus having a main valve which can be controlled by means of a pressure regulator with a closure member of the main valve being biased in closing direction by means of a spring comprising a diaphragm of the pressure regulator which is exposed to the pressure to be controlled carries a closure member of a bleed valve which connects a control pressure chamber of the main valve to an outlet of the control apparatus, a control spring determining the setpoint of the gas pressure biasing said diaphragm, an adjustable abutment for an end of said control spring opposite said diaphragm, a switch-on valve biased by a closure spring and located in the gas path between the inlet of the gas control apparatus and the pressure regulator, a solenoid consisting of a coil, a magnetic core and a tiltable armature has its armature on the one side contacting a valve rod of said switch-on valve and on the other side contacting a pin carrying said abutment of said control spring which is opposite said diaphragm and an armature reset spring has a stationary abutment for one of its ends and engages said armature with its other end after said armature has moved through a dead zone stroke which is sufficient for opening said switch-on valve.

2. An apparatus according to claim 1, wherein a blade spring is fixed to said armature, said blade spring acting with its free end upon said valve rod, and a cantilever extending essentially in parallel to said blade spring has its fixed end also attached to said armature and a free end engaging said pin.

3. An apparatus according to claim 2, wherein the relative position of said cantilever and said armature can be adjusted in the operating direction of said pin.

4. An apparatus according to claim 3, wherein said cantilever is a relatively stiff metal plate which is spaced from said armature between its free end and its fixed end, and that an adjusting screw screwed into said armature projects through a bore of said cantilever and said cantilever is spring biased in the direction of said armature by means of a head of said adjusting screw.

5. An apparatus according to claim 4, wherein the dead stroke zone is provided between said cantilever and said operating pin of said pressure regulator with the dead stroke being adjustable by means of said adjusting screw having such a length that the movement of said pin by means of said cantilever and the action of said armature reset spring upon said armature start simultaneously.

6. An apparatus according to claim 1, wherein said armature reset spring carries at its free end a sleeve-like transmission member and an adjusting screw adjustable within said armature projects a projection pin into said transmission member to engage the bottom of said transmission member when said switch-on valve is opened, and subsequently said adjusting screw acts upon said armature reset spring.

7. An apparatus according to claim 1, wherein two abutments are provided on said pin with both of said abutments cooperating with adjustable counter abutments provided in said housing for adjusting the minimum and the maximum outlet pressure of the apparatus.

8. An apparatus according to claim 7, wherein both of said counterabutments are formed by threaded sleeves movable within a tube member.

9. An apparatus according to claim 1, wherein said armature reset spring and said control spring are helical springs.

* * * * *